United States Patent [19]

Edlund et al.

[11] 4,404,646

[45] Sep. 13, 1983

[54] PIPING NETWORK ANALOG APPARATUS

[75] Inventors: Carl E. Edlund, Castroville; Cecil R. Sparks, San Antonio, both of Tex.

[73] Assignee: Southern Gas Association, Dallas, Tex.

[21] Appl. No.: 220,287

[22] Filed: Dec. 29, 1980

[51] Int. Cl.[3] ..... G06G 7/57

[52] U.S. Cl. ..... 364/803; 364/578; 364/510

[58] Field of Search ..... 364/801, 803, 806, 505, 364/506, 509, 510, 512, 578

[56] References Cited

U.S. PATENT DOCUMENTS 2,951,638 9/1960 Hughes et al. ..... 364/803

3,207,889 9/1965 Evangelisti et al. ..... 364/803

3,529,144 9/1970 Patterson et al. ..... 364/803 X 3,599,233 8/1971 Meyer ..... 364/803

*Primary Examiner*—Joseph F. Ruggiero

[57] ABSTRACT

Disclosed is an analog apparatus for simulating the low frequency pulsations and surge characteristics of centrifugal compressors and pumps and their interaction with piping systems. The apparatus includes a capacitor pump for simulating the pumping action of a centrifugal compressor. Voltages are applied to the input and output of the capacitor pump that are proportional to the section and discharge pressures of the compressor. The capacitor pump is driven electrically to simulate the action of the centrifugal compressor in a piping network.

1 Claim, 7 Drawing Figures

PIPING NETWORK ANALOG APPARATUS

This invention relates to apparatus for simulating the low frequency pulsations and surge characteristics of centrifugal compressors and pumps and their interaction with their piping systems.

BACKGROUND OF THE INVENTION

Centrifugal compressors have been widely used in pumping gaseous fluids through piping systems, especially in the transportation of natural gas through pipelines.

Experimental work both in the laboratory and with field centrifugal compressors have evidenced heretofore unexplained transient phenomena in at least two areas, (1) there is response of a compressor to pulsations from an external source which might be introduced into either the compressor suction or discharge piping and (2) the effects of compressor piping on machine surge.

Some of the more specific observed phenomena are:

(1) A centrifugal compressor can either amplify or attenuate external pulsations.

(2) Even with no positive source of pulsations in the piping system, low frequency pulsations can be experienced at levels sufficiently high to fatigue compressor internals or severely shake the piping.

(3) These pulsation problems can often be mitigated by changing the pulsation response of the compressor piping (lengths, diameters, etc.). High level pulsations have been observed at frequencies ranging from less than one Hz and approaching zero, to several hundred hertz. Frequencies are not harmonically related to and do not vary with centrifugal compressor speed.

(4) The severe pulsation frequencies normally relate to one of the major pipe resonances of the piping systems, and measurements along the piping show a strong standing wave pattern, often existing across or through the compressor.

(5) The onset, frequency, and severity of machine surge can also vary as the piping system is changed.

(6) Pulsation levels are most severe when the compressor is situated at or near a velocity maximum (pressure minimum) in the pulsation standing wave field.

(7) External pulsations can induce surge in a centrifugal compressor.

As will be seen later, it is one of the purposes of this invention to provide an analog of centrifugal compressor and its associated piping system in order that the above phenomena, as well as others, can be studied and various variables optimized to minimize the effect of pulsations and machine surge.

In accordance with this invention, a nonlinear analog is provided to be operated in such a manner that, in effect, the dynamic flow impedance characteristics of a piping system is superimposed upon the compressor curves and the combined characteristics are used to predict pulsation gain or loss and system stability and the effect of various variables upon them.

For a further understanding of the nature and objects of the present invention, reference should be had to the following detailed description, taken together with the accompanying drawings, wherein.

Figure 1:
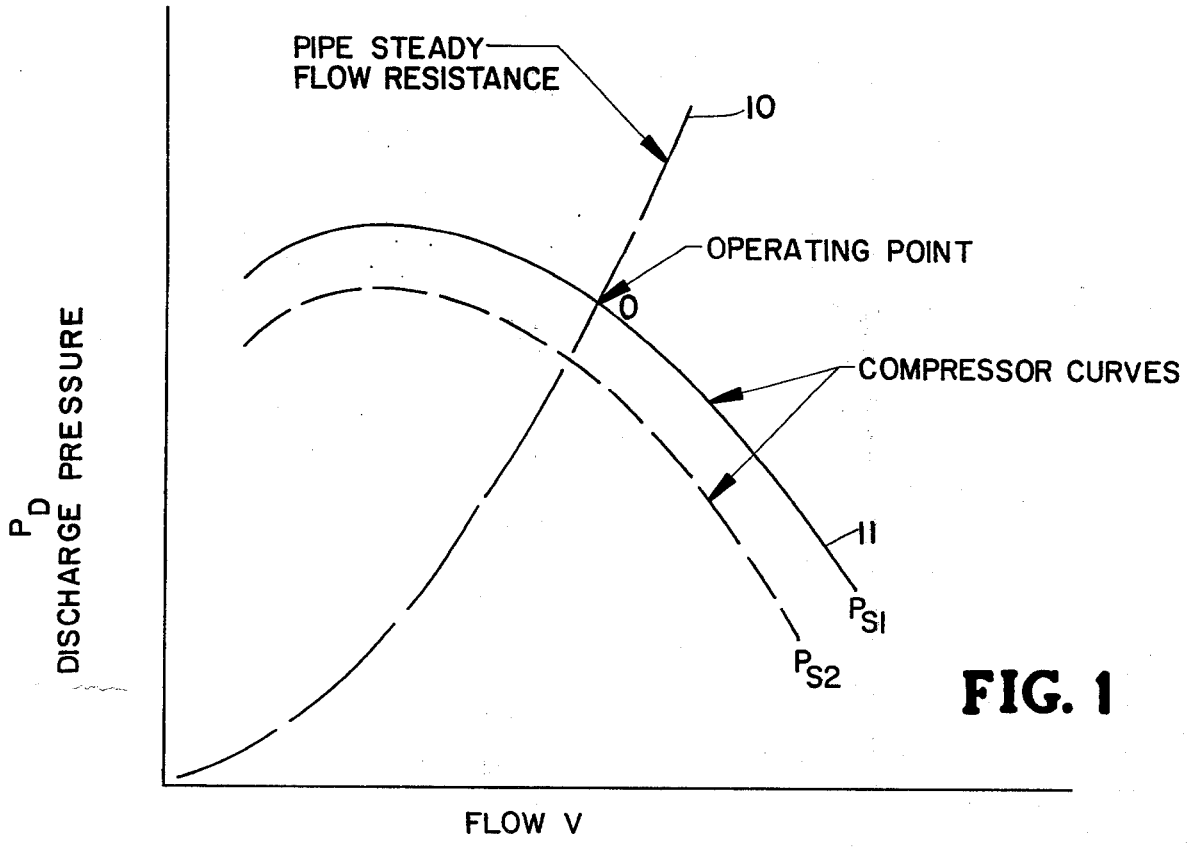
FIG. 1 is a plot of flow versus discharge pressure illustrating the basic nonlinear nature of pipe flow resistance.
Figure 2:
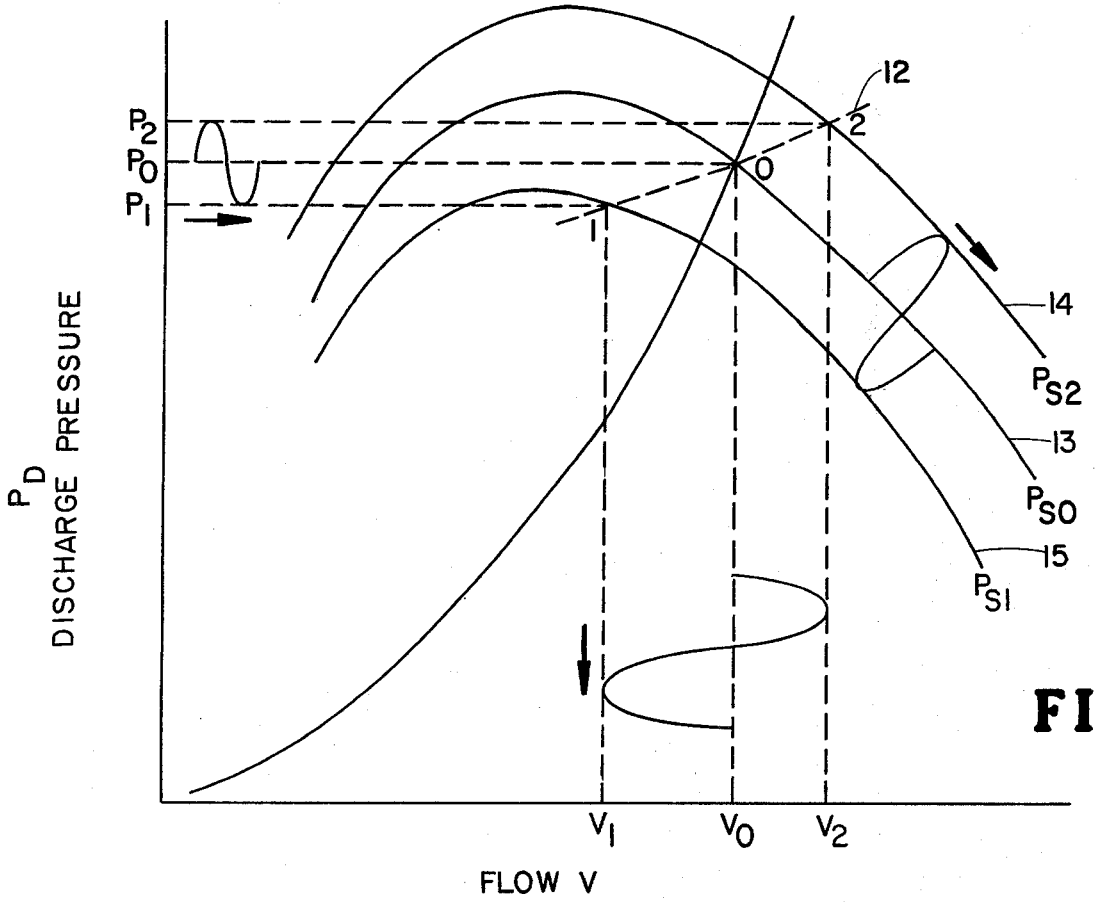
FIG. 2 is a plot of flow versus discharge pressure illustrating the effect of pressure modulation upon flow.

The basic nonlinear (square law) nature of pipe flow resistance is illustrated by the curve 10 in FIG. 1. Thus as its supply pressure is lowered, pipe flow will decrease, stop or perhaps even backflow. If a centrifugal compressor is the supply source, its performance curves can then be superimposed on the same plot by plotting compressor discharge pressure versus discharge flow velocity as shown by the curve 11 in FIG. 1, curve 11 being plotted for particular suction pressure $P_{S1}$. The operating point is the intersection of the two curves at point 0. Also shown in FIG. 1 is a second performance curve of the compressor (a dashed line) which can result from lowering suction pressure to $P_{S2}$ or compressor speed. In all cases, the operating point must fall on the pipe impedance curve so long as steady flow conditions are assumed and the pipe steady flow impedance is not changed. If, however, flow is modulated at higher frequencies where inertial effects and line pack effects are significant, then the steady state impedance curve sets the operating point but no longer controls the relation between pulsation pressures and flows. This results in a different impedance line drawn to the operating point and the slope of this dynamic impedance line is quite frequency sensitive for typical piping systems. The dynamic impedance frequency line is shown in FIG. 2 as line 12. In FIG. 2, the operating curves 13, 14 and 15 are shown for a centrifugal compressor operating at an average suction pressure $P_{S0}$ but pressure modulations cause this to vary from $P_{S1}$ to $P_{S2}$. Under these conditions, both the compressor curves and the pulsation impedance of the discharge line will influence flow and discharge pressure modulations. The slope of the dynamic impedance line 12 in FIG. 2 can be any positive value, theoretically, from near zero to a very high value, depending on pulsation frequency and transient response characteristics of the discharge piping.

Referring again to FIG. 2, it can be seen that when the discharge pressure modulation $(P_2-P_1)$ is larger than the suction pressure modulation $(P_{S2}-P_{S1})$ the compressor appears to amplify suction pressure pulsations, at least under those particular operating conditions, with that particular piping system and at that particular frequency. If the dynamic impedance line is sufficiently flat, then $P_2-P_1$ can approach zero and the compressor will effectively attenuate suction pressure pulsations.

Figure 3:
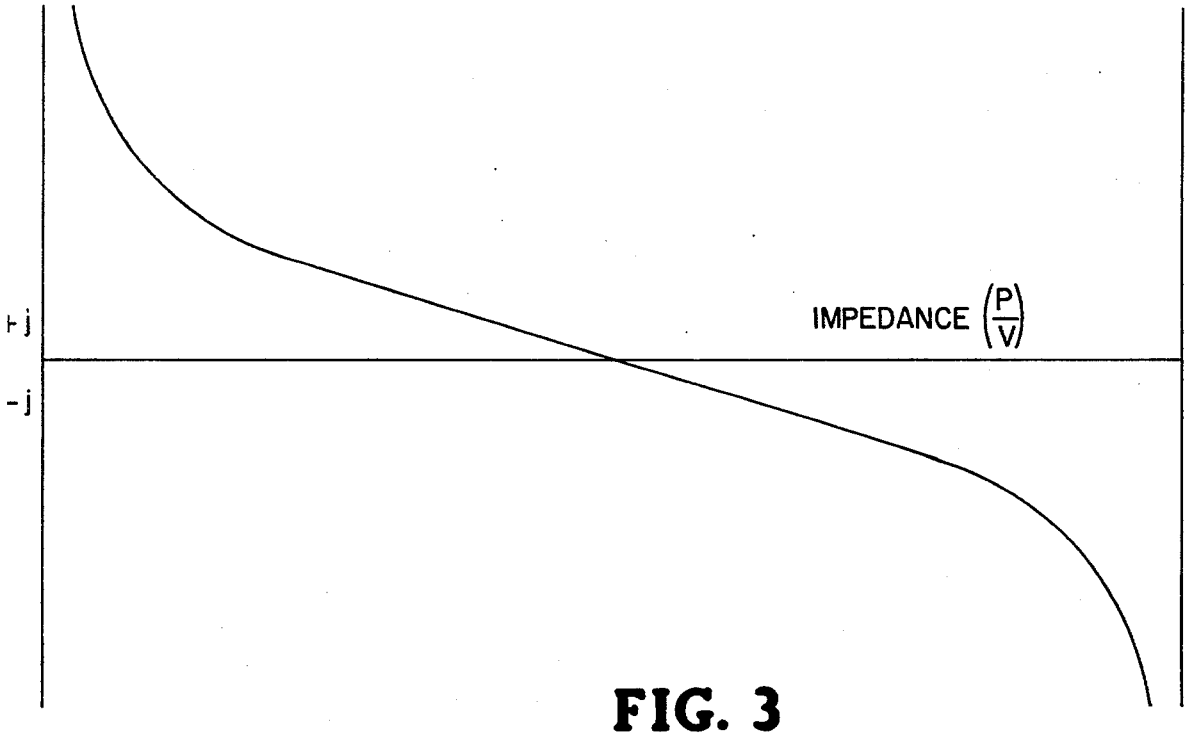
FIG. 3 is a plot of impedance versus length for the resonance mode of a fundamental half wave in a pipe or vessel closed at both ends.

FIG. 3 illustrates a plot of impedance versus length for the resonance mode of a fundamental half wave in a pipe or vessel closed at both ends. Thus the slope of the dynamic impedance line will vary from a relatively high value at the ends of the vessel to essentially zero at the center of the vessel. Thus if a compressor feeds such a vessel at its center point, a very low impedance would be evidenced at the frequency depicted. On the other hand, a very high impedance would be seen at feed points near the closed ends. Therefore, the magnitude of the dynamic impedance would vary markedly depending upon where the compressor feeds into the vessel and upon the perturbation frequency.

Figure 4:
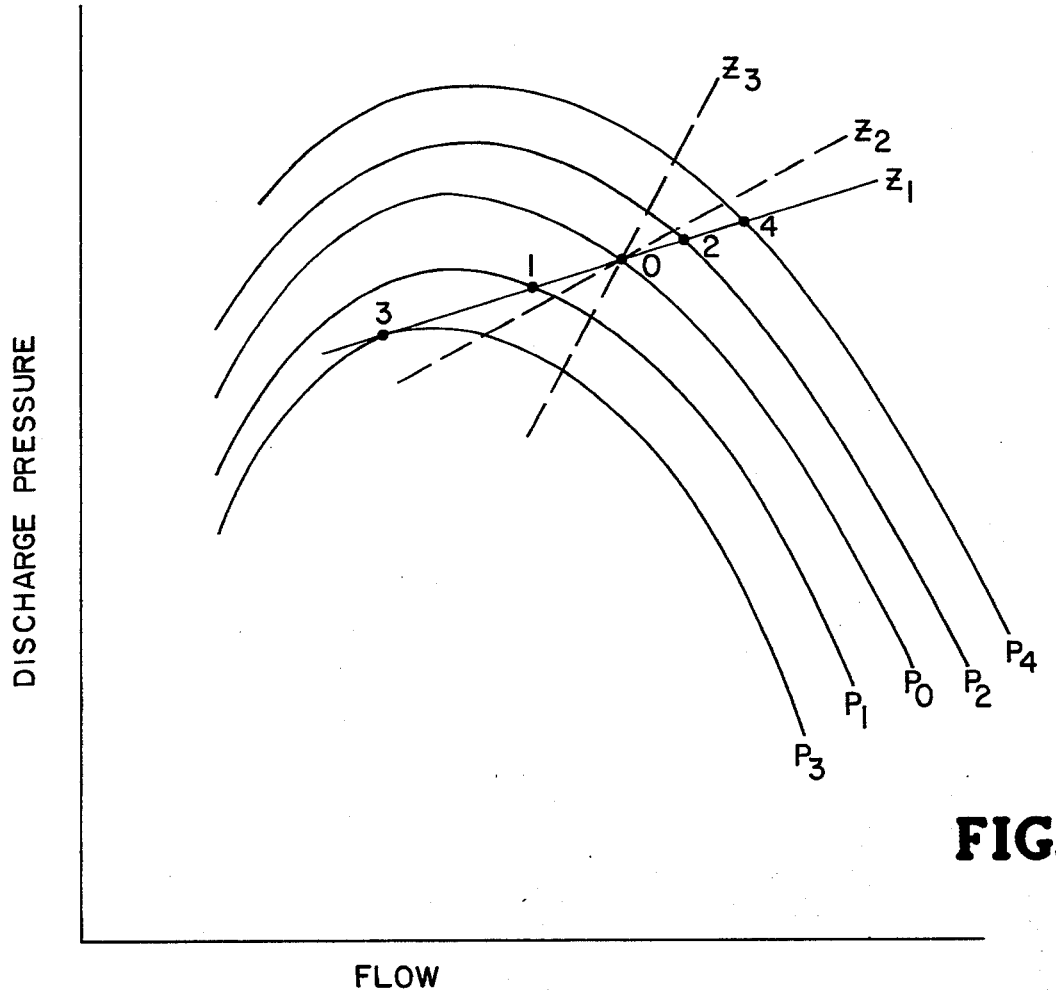
FIG. 4 is a plot of discharge pressure versus flow, which illustrates the effect of the slope of the dynamic load line upon the stability of the system.

Compressor surge has at times been a problem. To illustrate this, consider a set of compressor curves as shown in FIG. 4 with the operating point B and a dynamic load line as shown at $Z_1$. If the suction pressure is modulated from $P_1$ to $P_2$, the system is stable since in all cases the compressor head is sufficient to supply the discharge pressure required by the dynamic load line. However, if suction pressure drops below $P_3$, then the compressor cannot supply the piping pressure required to supply the necessary flow and flow therefore diminishes. As flow diminishes, the compressor head inadequacy becomes more pronounced and the entire flow regime collapses and surge results. The piping may begin to backflow locally into the compressor discharge to make up for the compressor inadequacy. As the suction pressure rises, then the compressor rebuilds up the load line into a temporary stable condition, but with a rather violent flow surge. The cycle then repeats.

As will be seen from FIG. 4, the steeper the slope of the dynamic load line, the more stable the system insofar as surge is concerned and a very high impedance system ($Z_3$) would never go into surge at all but would probably experience rotating stall instead.

Figure 5:
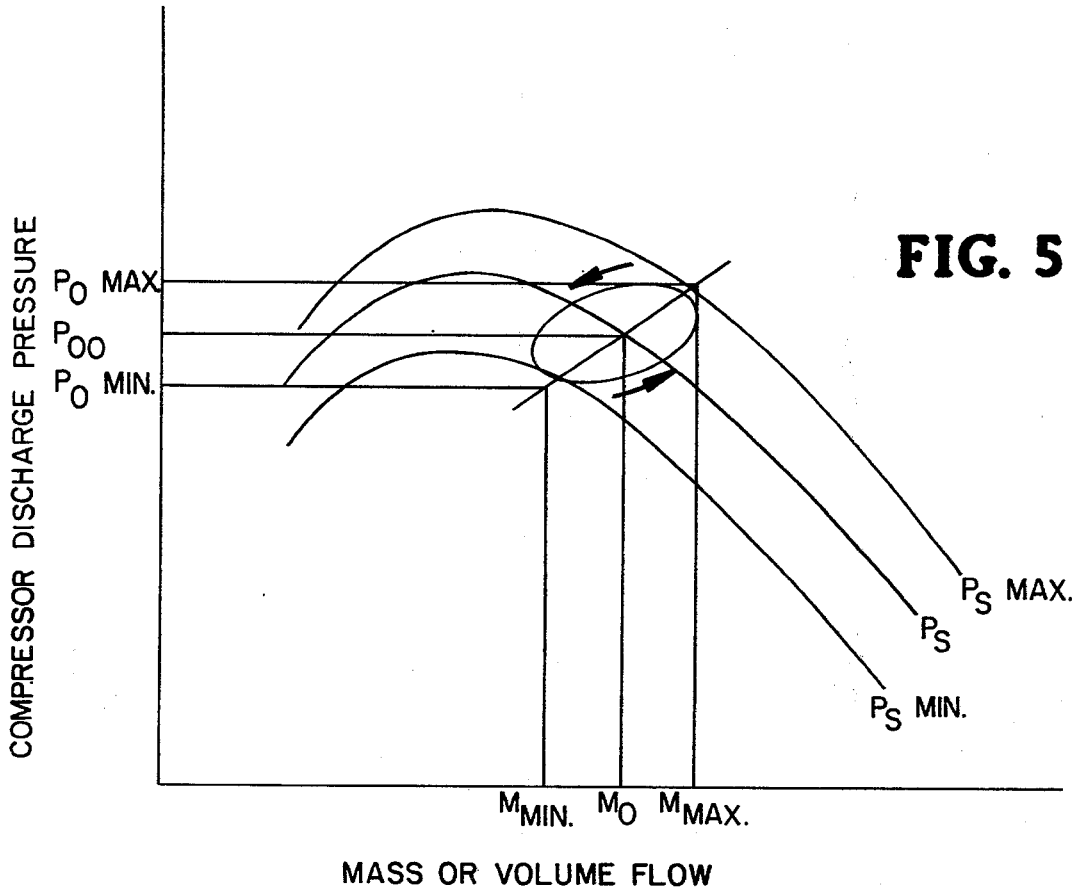
FIG. 5 is a plot of mass or flow volume versus compressor discharge pressure into a reactive piping system.
Figure 6:
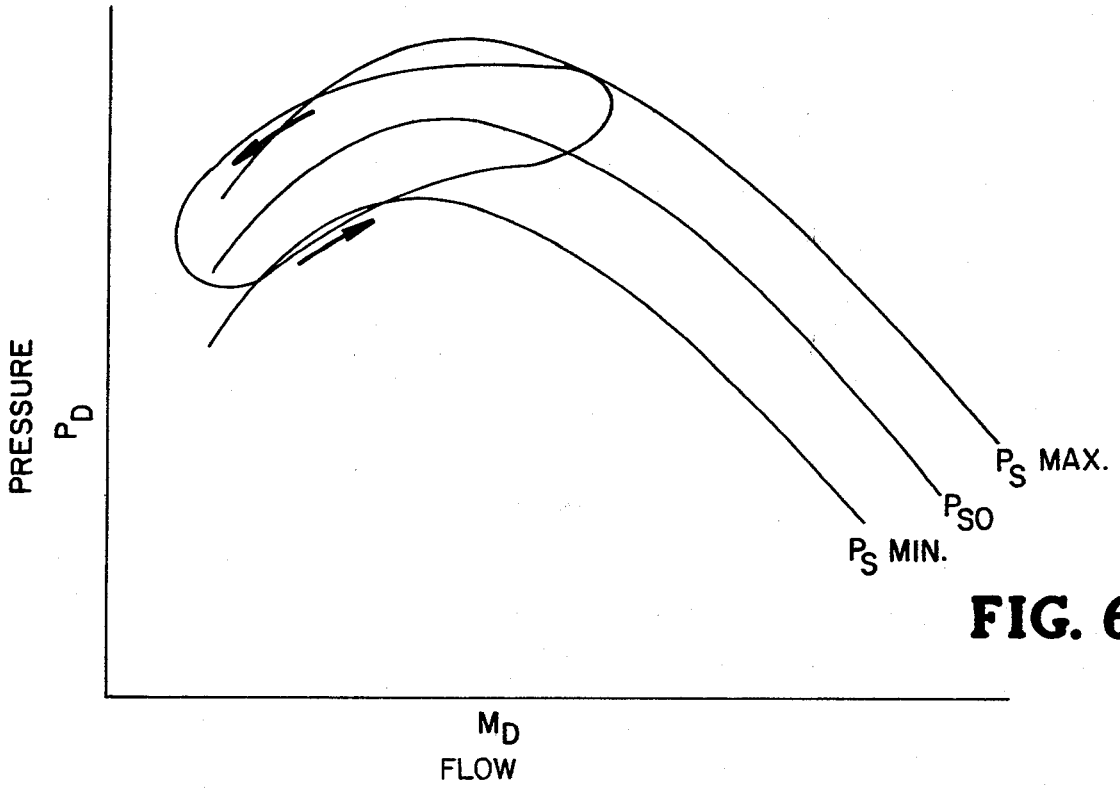
FIG. 6 is a plot illustrating the surge orbit pattern for the reactive system of FIG. 5.

The complexity of the pulsation pattern increases as the piping complexity increases for example, the illustration in FIG. 4 implies that discharge pressure and flow are in phase, a condition which can be achieved only in idealized piping systems. For a real system with branches and/or area discontinuities, phase shifts occur, and in fact approach 90 degrees near acoustic resonance. Such a condition is illustrated in FIG. 5 where the orbit of flow versus pressure into a reactive piping system is shown. The orbit of FIG. 5 for a reactive system is comparable to the line $Z_3$ in FIG. 4 for a non-reactive system, i.e. a state of stability. FIG. 6 illustrates a surge orbit pattern for the reactive system of FIG. 5. The complexity of FIGS. 5 and 6 illustrate the need for simulating the various interactions of parameters of the compressor and piping system.

In accordance with this invention, an analog is provided to simulate the operation of a centrifugal compressor utilizing an actual (non-linear) head curve in order to, among other things, simulate surge instability frequencies and amplitudes. Thus, it has been found that a conventional capacitor pump when driven by a sinusoidal voltage proportional to the sum of at least 3, and preferably 5 values, will simulate the dynamic characteristics of a centrigual compressor. When the input and output of the analog are connected to suitable delay lines and the like to simulate various piping configurations, the interaction of the compressor with the piping system can be simulated.

Figure 7:
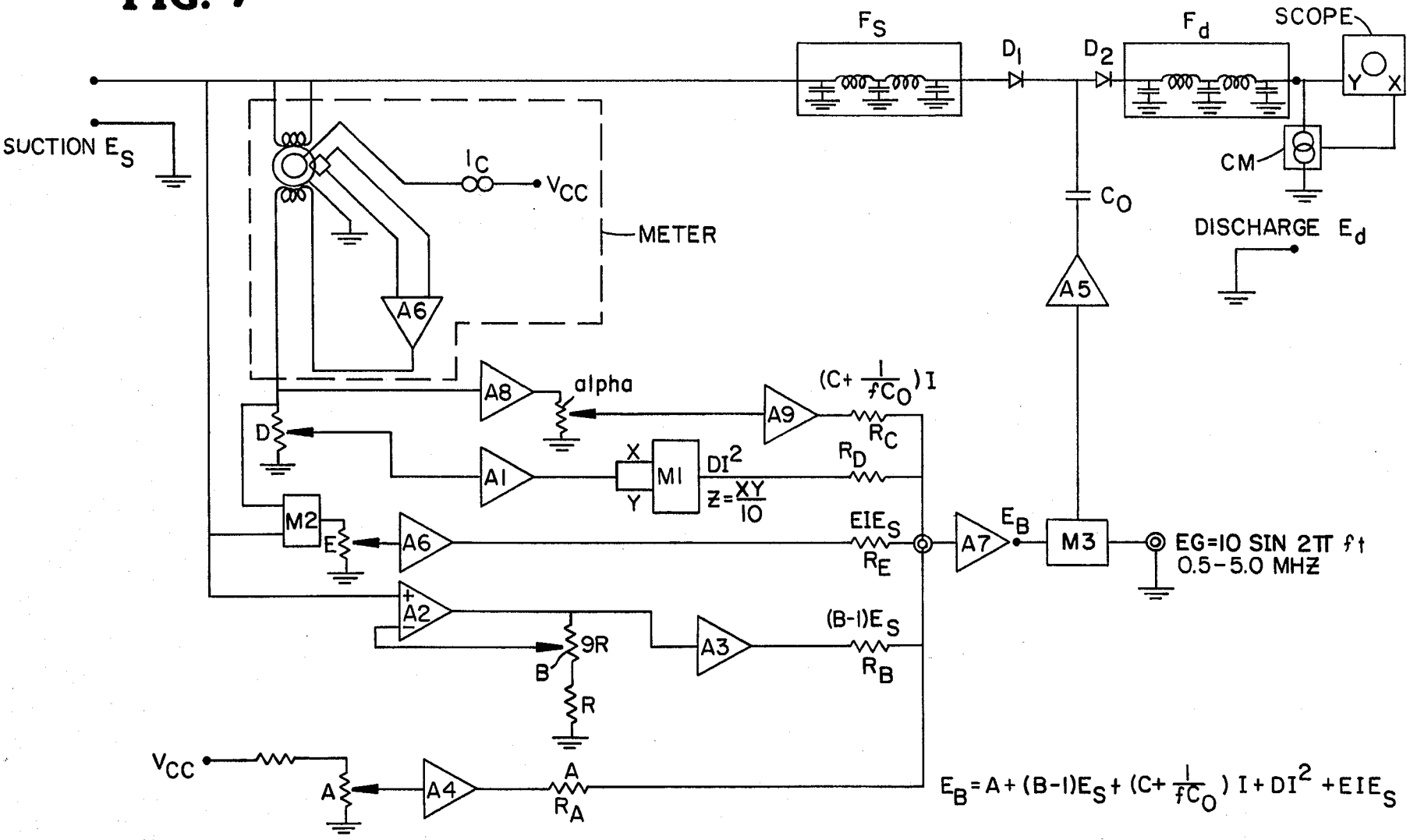
FIG. 7 is a schematic illustration of the preferred embodiment of the centrifugal compressor analog of the present invention.

Referring to FIG. 7, there is shown a conventional capacitor pump comprising the diodes $D_1$ and $D_2$ and the capacitor $C_0$, one form of which is described in the U.S. Pat. No. 2,951,638 along with the attendant delay lines for simulating a piping system. Thus there is provided a capacitor pump for simulating the pumping action of a centrifugal compressor and having circuits (not shown) connected to the input and output analogizing the piping upstream and downstream of the compressor.

Means are also supplied for applying a voltage to the input of the capacitor pump which is proportional to the suction pressure of the compressor, this means being indicated by "Suction $E_s$". Similarly, means are provided for applying a voltage to the output of the capacitor pump proportional to the discharge pressure and indicated by the term "Discharge $E_d$".

$F_S$ and $F_d$ are low pass filters which are inserted to filter out any stray alternating currents which may have an adverse effect on the capacitor pump.

Electrical means are provided for driving the capacitor pump to cause it to simulate the action of the centrifugal compressor in the piping network. The driving means has a sinusoidal voltage output which is proportional to the sum $$E_B = A + (B-1)E_S + \left(C + \frac{1}{fC_o}\right) I + DI^2 + EIE_s. \tag{1}$$

The driving means includes a first means for sensing the suction voltage here shown as amplifier A2. Means are also provided for scaling the output of the first means (A2) by a first factor (B-1), here illustrated as the potentiometer B, to yield the value (B-1) $E_s$ in equation (1). (B-1) is derived by appropriate feed back around amplifier A2 as shown from the resistor network 9R and R.

Means are also provided for sensing and scaling the current flow through the capacitor pump by a second factor:

$$C + \frac{1}{fC_o} \tag{2}$$

to yield the value $$\left(C + \frac{1}{fC_o}\right) I. \tag{3}$$

where C is a numerical coefficient and $C_0$ is the value of capacitance $C_0$ in the circuit. This means is illustrated as including the amplifier A8 and potentiometer alpha. The latter is set in accordance with the calculated value of equation (2) above. In this connection, the components within the dashed block labeled "METER" is a Hall effect metering circuit fully described in copending application Ser. No. 94,507, filed Nov. 15, 1979 to which reference is made for further details and the disclosure of which is incorporated by reference in full herein. In any event, the current flowing to amplifier A8 is directly proportional to the current flowing through the capacitor pump.

As a part of the driving means, means are also provided for squaring and scaling the current flow through the capacitor pump to obtain the value:

$$DI^2. \tag{4}$$

This means includes a potentiometer D for scaling the current being fed to amplifier A1 and a wide band precision analog multiplier M1 which squares the current value multiplied by the factor D.

Means are also provided for scaling a constant voltage by a fourth factor which includes a constant voltage source $V_{cc}$, and a scaling potentiometer A to obtain value A.

Means are also provided for multiplying the suction voltage $E_s$ by the current flowing through the capacitor pump and scaling the result by a fifth factor E to obtain the value:

$$EIE_s \quad (5)$$

Thus wide band precision analog multiplier M2 is employed to multiply the current and voltage as shown and the output is scaled in potentiometer E and then passed to amplifier A6.

Means are also provided for adding the foregoing values in accordance with equation (1) to provide a sum voltage $E_B$. This means of addition includes resistors $R_A$, $R_B$, $R_C$, $R_D$ and $R_E$ hooked into an adding circuit as shown and amplifier A7. The various factors involved in these means are selected to define the coefficient of the terms of the above equation which equation in turn defines the sum voltage required for the electrical driving means to cause the capacitor pump to simulate the behavior of the centrifugal compressor. As shown in the drawing, the sum voltage is applied to a broad band precision analog multiplier M3 where the sum voltage is multiplied by a sinusoidal voltage EG of constant magnitude and frequency. As a result, the sinusoidal voltage fed to amplifier A5 has an ampitude proportional to the sum voltage.

It is preferred that the amplifiers A1 through A9 all be wide band precision analog amplifiers.

To simulate a given compressor head curve and therefore to arrive at an $E_B$ which will drive the capacitor pump to cause such simulation of such a given head curve, a current modulator CM can be provided as shown in FIG. 7 and an oscilloscope connected as shown to display the output of the capacitor pump. The current modulator causes a periodic variation in current flow and provides an analog voltage output which is proportioned to such current, which voltage is used to drive the X-axis of the oscilloscope. The Y-axis is driven directly by $E_d$. Then using the given head curve, the various coefficients of equation 1 can be adjusted in the circuit of FIG. 7 to force conformance of the capacitor pump output curve, which is $E_d$, to the desired head or performance curve.

What is claimed is:

1. An electrical analog of a piping network having a centrifugal compressor or pump therein comprising:

(a) a capacitor pump for simulating the pumping action of a centrifugal compressor and having circuits connected to its input and output simulating the piping upstream and downstream of said compressor:

(b) means for applying voltages to the input and output of said capacitor pump which are proportional to the suction and discharge pressures of said compressor:

(c) and electrical means for driving said capacitor pump to cause it to simulate the action of the centrifugal compressor in said piping network including:

i. means for scaling a constant voltage by a fourth factor A ii. first means for sensing the suction voltage, iii. means for scaling the output of said first means by a first factor (B-1)

iv. means for sensing and scaling the current flow through said capacitor pump by a second factor $$\left(C + \frac{1}{fCo}\right)$$

v. means for squaring and scaling said current flow respectively by a third factor D vi. means for multiplying the suction voltage by the current and means for scaling the result by a fifth factor E; and means for adding the outputs of items (ii), (iii), (iv), (v) and (vi) to provide a sum voltage Eb; and means for generating a sinusoidal voltage having an ampitude proportional to said sum voltage as the driving voltage for said capacitor pump.

* * * * *